US010729215B2

(12) United States Patent
Seegmiller

(10) Patent No.: US 10,729,215 B2
(45) Date of Patent: Aug. 4, 2020

(54) COMPRESSIBLE CONTAINER FOR BACKPACKING AND METHOD THEREOF

(71) Applicant: Dzuke, LLC, Logan, UT (US)

(72) Inventor: Benjamin L. Seegmiller, Richfield, UT (US)

(73) Assignee: Dzuke, LLC, Richfield, UT (US)

( * ) Notice: Subject to any disclaimer, the term of this patent is extended or adjusted under 35 U.S.C. 154(b) by 39 days.

(21) Appl. No.: 16/013,955

(22) Filed: Jun. 21, 2018

(65) Prior Publication Data

US 2018/0368545 A1 Dec. 27, 2018

Related U.S. Application Data

(60) Provisional application No. 62/524,437, filed on Jun. 23, 2017.

(51) Int. Cl.

| | |
|---|---|
| ***A45C 7/00*** | (2006.01) |
| ***A45C 13/30*** | (2006.01) |
| ***A45C 13/10*** | (2006.01) |
| ***A45C 13/02*** | (2006.01) |
| *A45F 3/04* | (2006.01) |

(52) U.S. Cl.

CPC ..... *A45C 7/0077* (2013.01); *A45C 13/02* (2013.01); *A45C 13/1092* (2013.01); *A45C 13/30* (2013.01); *A45F 3/04* (2013.01)

(58) Field of Classification Search

None

See application file for complete search history.

(56) References Cited

U.S. PATENT DOCUMENTS

| | | | | |
|---|---|---|---|---|
| 1,115,706 A | | 11/1914 | Manuel | |
| 1,583,083 A | | 6/1924 | Macaraig | |
| 1,691,904 A | | 11/1928 | Gamble | |
| 1,730,898 A | | 10/1929 | Percival | |
| 1,847,066 A | | 3/1932 | Berg | |
| 1,902,313 A | | 3/1933 | Struble | |
| 2,016,520 A | * | 10/1935 | Short | A45C 7/0077 206/289 |
| 2,389,910 A | | 3/1944 | Hoffman | |
| 2,845,185 A | | 10/1954 | Winderweedle, Jr. | |

(Continued)

FOREIGN PATENT DOCUMENTS

| | | | | |
|---|---|---|---|---|
| CH | 709803 A2 | * | 12/2015 | |
| GB | 225610 A | * | 12/1924 | B60R 9/065 |

*Primary Examiner* — Charlie Y Peng

(74) *Attorney, Agent, or Firm* — David L. Stott

(57) ABSTRACT

Embodiments of a container and method thereof for fitting within a backpack or daypack. The container includes a tubular liner extending between a first end and a second end and defining an axis, the tubular liner including a flexible side wall so that the tubular liner is moveable between a collapsed state and an expanded state. The tubular liner includes multiple partitions defined therein and extends generally orthogonal relative to the axis within the tubular liner. Upon the tubular liner being in the expanded state, the tubular liner includes multiple storage regions defined, at least in part, by the multiple partitions and the flexible side wall. The flexible side wall includes a door flap moveable between an open position and a closed position such that, upon the door flap being in the open position, the door flap facilitates access to the multiple storage regions defined within the tubular liner.

19 Claims, 7 Drawing Sheets

(56) References Cited

U.S. PATENT DOCUMENTS

| | | | | |
|---|---|---|---|---|
| 2,943,899 | A | 7/1960 | Beller | |
| 3,572,251 | A * | 3/1971 | Johnson | A47G 25/54 104/89 |
| 3,669,276 | A | 6/1972 | Woods | |
| 3,904,258 | A | 9/1975 | Faulkenberry | |
| 4,082,389 | A | 4/1978 | Stewart | |
| 4,867,513 | A | 9/1989 | Choi | |
| 6,830,170 | B2 * | 12/2004 | Abel | A01M 31/006 190/107 |
| 7,063,397 | B2 | 7/2006 | Sabounjian | |
| 9,839,281 | B2 * | 12/2017 | Pompliano | A45F 4/02 |
| 9,943,166 | B1 | 4/2018 | Cleary | |
| 9,999,299 | B2 * | 6/2018 | Neuwirth | A47B 43/04 |
| 10,194,732 | B2 * | 2/2019 | Sagan | A45F 3/04 |
| 2005/0023229 | A1 * | 2/2005 | Ashley | A47B 43/006 211/38 |
| 2007/0090062 | A1 | 4/2007 | Girault et al. | |
| 2008/0210727 | A1 * | 9/2008 | Gallaway | A45C 13/02 224/575 |
| 2010/0276241 | A1 | 11/2010 | Malone | |
| 2017/0156461 | A1 * | 6/2017 | Chaffee | A45C 3/04 |
| 2017/0280841 | A1 * | 10/2017 | Lopez | A45C 7/0077 |
| 2019/0183219 | A1 * | 6/2019 | Yu | A45C 7/0063 |
| 2019/0289970 | A1 * | 9/2019 | McGuire | A45C 7/0077 |

* cited by examiner

COMPRESSIBLE CONTAINER FOR BACKPACKING AND METHOD THEREOF

CROSS-REFERENCE TO RELATED APPLICATIONS

The present application claims the benefit of U.S. Provisional Application No. 62/524,437, filed Jun. 23, 2017, the disclosure of which is hereby incorporated by reference in its entirety.

TECHNICAL FIELD

The present invention relates generally to backpacking equipment and, more specifically, to a compressible partitioned container as an accessory for backpacking and the like.

BACKGROUND

Backpacking and day adventures are popular past times for many, getting away from the busyness of one's life for a retreat to the outdoors. Packing for such trips typically involves positioning several items in a perceived organized manner within one or two compartments of a backpack or daypack. Depending upon the type of outdoor retreat at hand, the packed items typically take-up all the limited space available in the backpack. Keeping the items organized within ones backpack and remembering where each item is located is difficult and can progressively become more difficult throughout the time of the retreat. For example, several instances within a given day, one will typically need to locate one or two items within the backpack. Each instance can result in removing a majority of one's items from the backpack until the desired items are located. The time spent locating desired items and then re-packing the items in the backpack is a cumbersome process that can result in frustration and, at the least, results in time lost from more enjoyable activities during the outdoor retreat.

BRIEF SUMMARY OF THE INVENTION

Embodiments of the present invention are directed to an expandable and compressible container configured to facilitate portability, organization and storage of various items therein. In one embodiment, the compressible container includes a tubular liner that extends between a first end and a second end and defines a longitudinal axis along a length of the tubular liner. The tubular liner includes a flexible side wall with a door flap defined therein such that the tubular liner is moveable between an expanded state and a collapsed state. The flexible side wall of the tubular liner extends to define an interior surface and an exterior surface, the tubular liner including multiple spaced apart partitions extending from the interior surface of the flexible side wall so as to define multiple storage regions within the tubular liner to be accessible via the door flap. Further, the tubular liner includes multiple first end straps and multiple second end straps coupled to the first end and the second end, respectively, of the tubular liner. Also, the tubular liner includes loops attached to the exterior surface of the flexible side wall, each one of the loops positioned and aligned along the flexible side wall between one of the first end straps and one of the second end straps. With this arrangement, upon one of the first end straps being coupled to another one of the first end straps, the coupled first end straps are configured to facilitate hanging the tubular liner so that the tubular liner is disposed in the expanded state. Furthermore, with this arrangement, upon one of the first end straps being coupled to one of the second end straps so that one of the first and second end straps is coupled to one of the loops, at least one of the one of the first and second end straps are cinchable to move the tubular liner to a compressed state.

In another embodiment, each of the multiple first end straps extend with a length between a fixed end and a free end, the fixed end coupled to the first end of the tubular liner with an adjustable coupling portion slidably attached along the length of each of the first end straps to facilitate adjusting a distance between the adjustable coupling portion and the fixed end. In a further embodiment, the adjustable coupling portion includes either a male coupling portion or a female coupling portion.

In another embodiment, each of the multiple first end straps include one end coupled adjacent to a periphery of the first end of the tubular liner such that the one end of each of the multiple first end straps are spaced along the periphery. In another embodiment, each of the multiple second end straps include one end coupled adjacent to a periphery of the second end of the tubular liner such that the one end of each of the multiple second end straps are spaced along the periphery.

In another embodiment, the loops include upper loops and lower loops, one of the upper loops and one of the lower loops being positioned and aligned on the exterior surface between one of the multiple first end straps and one of the multiple second end straps. In still another embodiment, upon coupling one of the first end straps to one of the second end straps, at least one of the first end straps and the second end straps are threadably coupled to one of the loops to assist the tubular liner being maintained in the compressed state.

In accordance with another embodiment of the present invention, a compressible container configured to store various items therein is provided. In one embodiment, the compressible container includes a tubular liner, multiple first end straps, and multiple second end straps. The tubular liner extends with a flexible side wall between a first end and a second end, the flexible side wall extending to define an interior surface and an exterior surface. The tubular liner includes multiple partitions spaced apart and each extending from the interior surface to define storage regions within the tubular liner such that the storage regions are accessible through a door flap defined in the flexible side wall. The multiple first end straps each include one end coupled to the first end of the tubular liner and each include a first coupling portion slidably coupled thereto so as to be slideable along the first end straps to adjust a length between the first coupling portion and the one end of each of the first end straps. The multiple second end straps each having one end coupled to the second end of the tubular liner. Further, each one of the second end straps include a second coupling portion slidably coupled thereto so as to be slideable along the second end straps to adjust a length between the second coupling portion and the one end of each of the second end straps. With this arrangement, the first coupling portion of one of the first end straps is configured to be coupled to the second coupling portion of one of the second end straps such that the first and second end straps are configured to be cinched down to move the tubular container to a compressed state.

In another embodiment, the compressible container further includes multiple loops coupled to the exterior surface of the flexible side wall, each loop being positioned and aligned between one of the first end straps and one of the second end straps such that one of the first and second end straps are threaded through one of the loops aligned therewith to assist in centering the tubular liner upon being cinched down to the compressed state. In another embodiment, the loops include upper loops and lower loops, one of the upper loops and one of the lower loops being positioned and aligned on the exterior surface between one of the multiple first end straps and one of the multiple second end straps.

In another embodiment, the first coupling portion and the second coupling portion each include either a male coupling portion or a female coupling portion. In another embodiment, one of the first end straps is configured to couple to another one of the first end straps at the first end of the tubular liner such that the tubular liner is configured to hang by at least two of the first end straps to position the tubular liner in an expanded state. In another embodiment, the tubular liner extends to define a longitudinal axis along a length of the tubular liner such that the multiple partitions are oriented generally orthogonal relative to the longitudinal axis. In yet another embodiment, upon the tubular liner being moved to the compressed state, a size of the tubular liner and the items positioned therein are minimized to facilitate portability of the tubular liner.

In accordance with another embodiment of the present invention, a method for storing items in a backpack or daypack is provided. In one embodiment, the method includes the steps of: providing a tubular container extending with a flexible side wall between a first end and a second end, the flexible side wall extending to define an interior surface and an exterior surface, the tubular container including multiple partitions spaced apart and each extending from the interior surface to define storage regions within the tubular container, the tubular container including multiple first end straps and multiple second end straps coupled to the first end and the second end, respectively, of the tubular container, the tubular container including loops attached to the exterior surface of the flexible side wall, each one of the loops positioned and aligned along the flexible side wall between one of the first end straps and one of the second end straps; accessing the storage regions through a door flap defined in the flexible side wall; positioning the items within at least some of the storage regions of the tubular container; extending at least one of the first end straps and one of the second end straps through one of the loops aligned therebetween; coupling the one of the first end straps to the one of the second end straps with an adjustable tensioning coupling mechanism associated with at least one of the one of the first end straps and the one of the second end straps; and adjusting a length of at least one of the coupled one of the first end straps and the one of the second end straps with the adjustable tensioning coupling mechanism so as to cinch down the tubular container to a compressed state to minimize a size of the tubular container with the items stored therein and facilitate portability of the tubular container.

In another embodiment, the method steps of extending and coupling includes extending four of the first end straps from the first end of the tubular container and extending four of the second end straps from the second end of the tubular container and coupling the four of the first end straps to corresponding and aligned ones of the four of the second end straps. In another embodiment, the method further includes decoupling the one of the first end straps from the one of the second end straps so that the tubular container is removed from the compressed state; and coupling one of the first end straps to another one of the first end straps to provide an upper loop portion with at least two of the first end straps for positioning the upper loop portion over an object so that the tubular container is suspended and moves to an expanded state. In another embodiment, the method further includes opening the door flap for accessing the items within the storage regions upon the container being moved to the expanded state. In still another embodiment, the method further includes decoupling the one of the first end straps from the one of the second end straps so that the tubular container is moved from the compressed state to a collapsed state. In yet another embodiment, the method further includes positioning the tubular container within an enclosable space within the backpack or the daypack upon the container being in the compressed state.

In accordance with another embodiment of the present invention, a container configured to fit within a backpack is provided. The container includes a tubular liner extending between a first end and a second end and defining an axis. The tubular liner includes a flexible side wall so that the tubular liner is moveable between a collapsed state and an expanded state. Further, the tubular liner includes multiple partitions therein that extend generally orthogonal relative to the axis within the tubular liner. The flexible side wall includes a door flap moveable between an open position and a closed position. Upon the tubular liner being in the expanded state, the tubular liner includes multiple storage regions defined, at least in part, by the multiple partitions and the flexible side wall. Further, upon the door flap being in the open position, the door flap facilitates access to the multiple storage regions defined within the tubular liner.

In another embodiment, the tubular liner includes a polymeric material. In still another embodiment, the tubular liner includes rip-stop nylon. In another embodiment, each of the multiple partitions include a resilient member extending along a periphery thereof. In still another embodiment, the first end of the tubular liner includes a rigid member extending along a periphery of the first end. In yet another embodiment, each of the multiple partitions includes a circular periphery. In another embodiment, the first end defines an exterior surface with a strap attached thereto, the strap including an attachment mechanism. In another embodiment, the door flap is moved between the open and closed positions with a zipper mechanism.

In accordance with another embodiment of the present invention, a method for storing and organizing items in a backpack is provided. In one embodiment, the method includes: providing a container including a tubular liner extending between a first end and a second end and defining an axis, the tubular liner including a flexible side wall so that the tubular liner is moveable between a collapsed state and an expanded state, the tubular liner including multiple partitions therein and extending generally orthogonal relative to the axis within the tubular liner, the flexible side wall including a door flap moveable between an open position and a closed position; positioning the tubular liner in the expanded state to maximize a spacing of multiple storage regions defined, at least in part, by the multiple partitions and the flexible side wall; and exposing the multiple storage regions by moving the door flap to the open position to facilitate access to the multiple storage regions defined within the tubular liner.

In another embodiment, the method further includes positioning the items within any one of the storage regions. In still another embodiment, the method further includes inserting the container within a space defined within the backpack.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
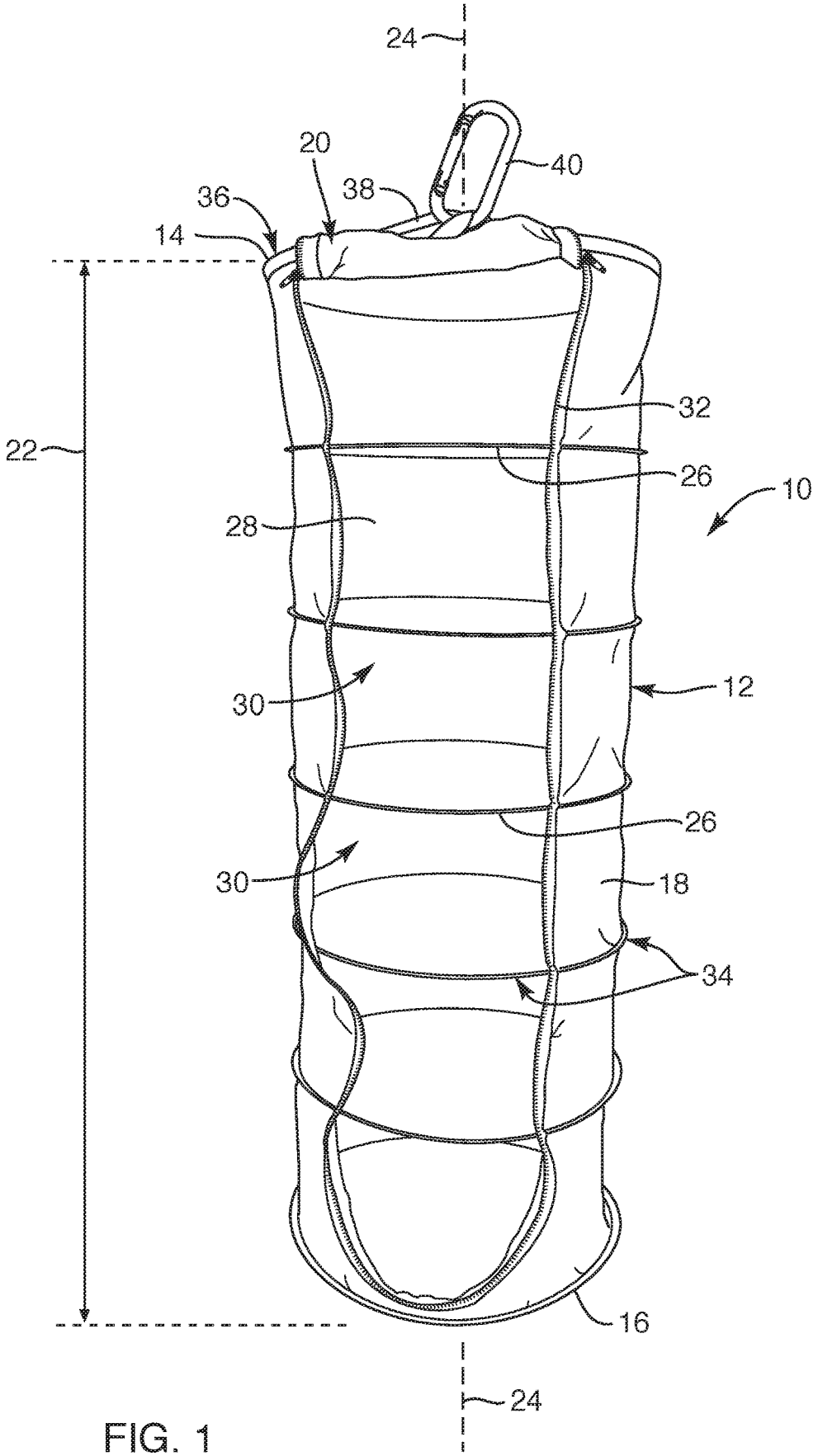
FIG. 1 is a perspective front view of a partitioned container in a vertical hanging position and an expanded position, depicting the partitioned container with a door flap in an open position, according to an embodiment of the present invention.
Figure 5:
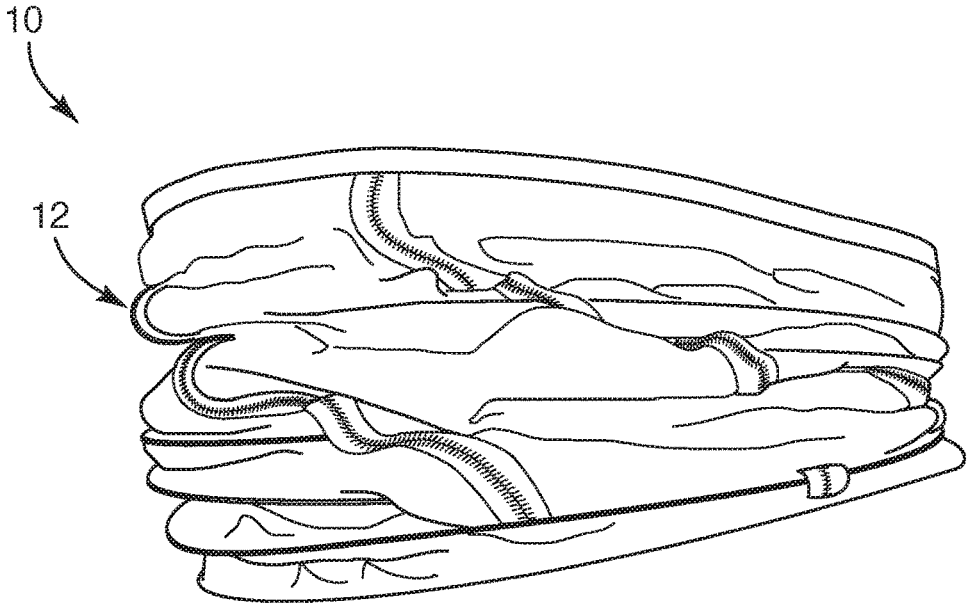
FIG. 5 is a perspective side view of the partitioned container in a collapsed position, according to another embodiment of the present invention.
Figure 6:
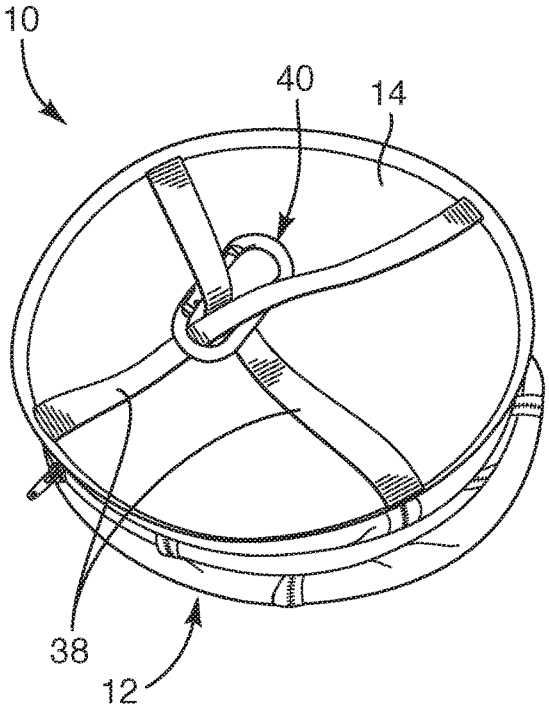
FIG. 6 is a perspective end view of the partitioned container in the collapsed position, according to another embodiment of the present invention.

Referring first to FIG. 1, a container 10 sized and configured to facilitate portability, organization and storage of various items therein is provided. As depicted in FIG. 1, the container 10 may extend to an expanded state and may also be placed in or moved to a collapsed state (FIGS. 5 and 6). The container 10 may be sized so as to fit within a space defined within, for example, a main body of a backpack. Further, the container 10 is light weight and may be moved to various configurations to facilitate portability and may be readily positioned and stored within various sized confined spaces.

The container 10 may be in the form of a tubular liner 12 that extends between a first end 14 and a second end 16 with a flexible side wall 18. The flexible side wall 18 may include a door flap 20 defined and extending along a longitudinal length 22 of the tubular liner 12. The first and second ends 14, 16 may be closed ends and extend generally transverse or orthogonal relative to the flexible side wall 18. In the expanded state, the flexible side wall 18 may extend with a tubular configuration and define a longitudinal axis 24 along the length 22 of the tubular liner 12. Further, the tubular liner 12 may extend and define a generally circular cross-sectional profile taken laterally relative to the axis 24.

The tubular liner 12 may include multiple partitions 26 therein. The multiple partitions 26 may be spaced apart along the length 22 of the tubular liner 12. Further, in one embodiment, the multiple partitions 26 may be evenly spaced along the length 22 of the tubular liner 12. The multiple partitions 26 may be attached to an inner surface 28 of the flexible side wall 18. The multiple partitions 26 may also extend generally orthogonal or transverse relative to the side wall 18 and axis 24. The multiple partitions 26 may extend substantially planar with a disc shape sized to extend from the flexible side wall 18 and attach thereto.

Figure 2:
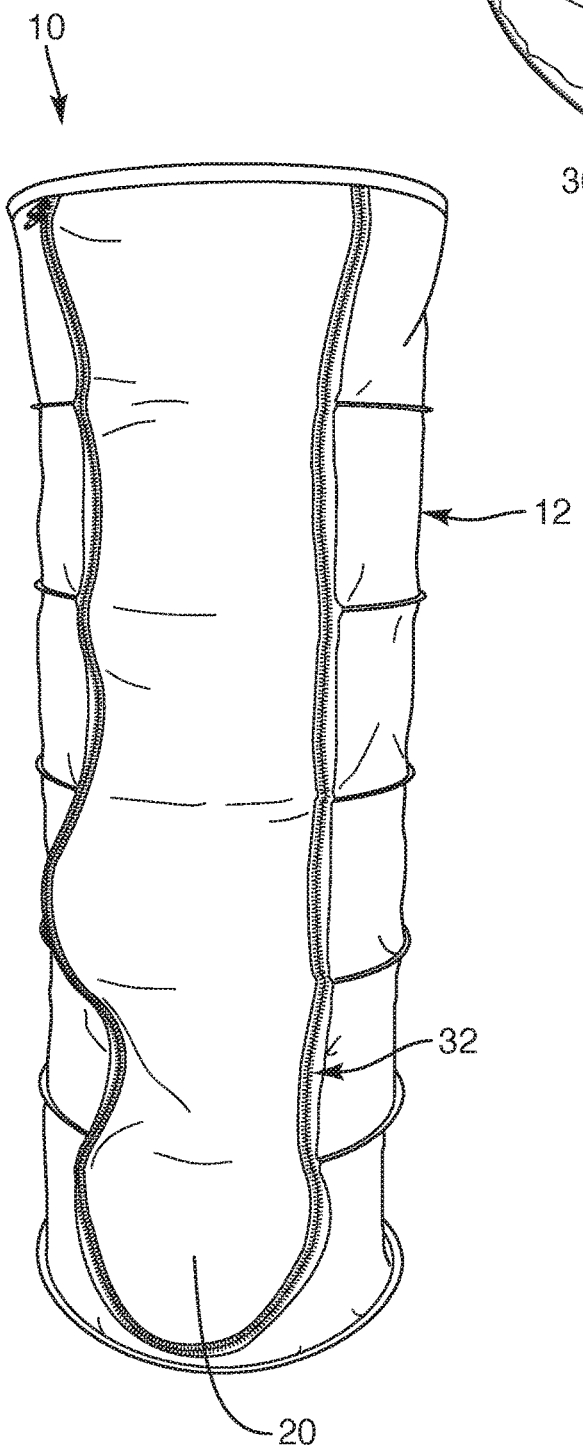
FIG. 2 is a perspective front view of the partitioned container in the expanded position, depicting the partitioned container with the door flap in a closed position, according to another embodiment of the present invention.
Figure 3:
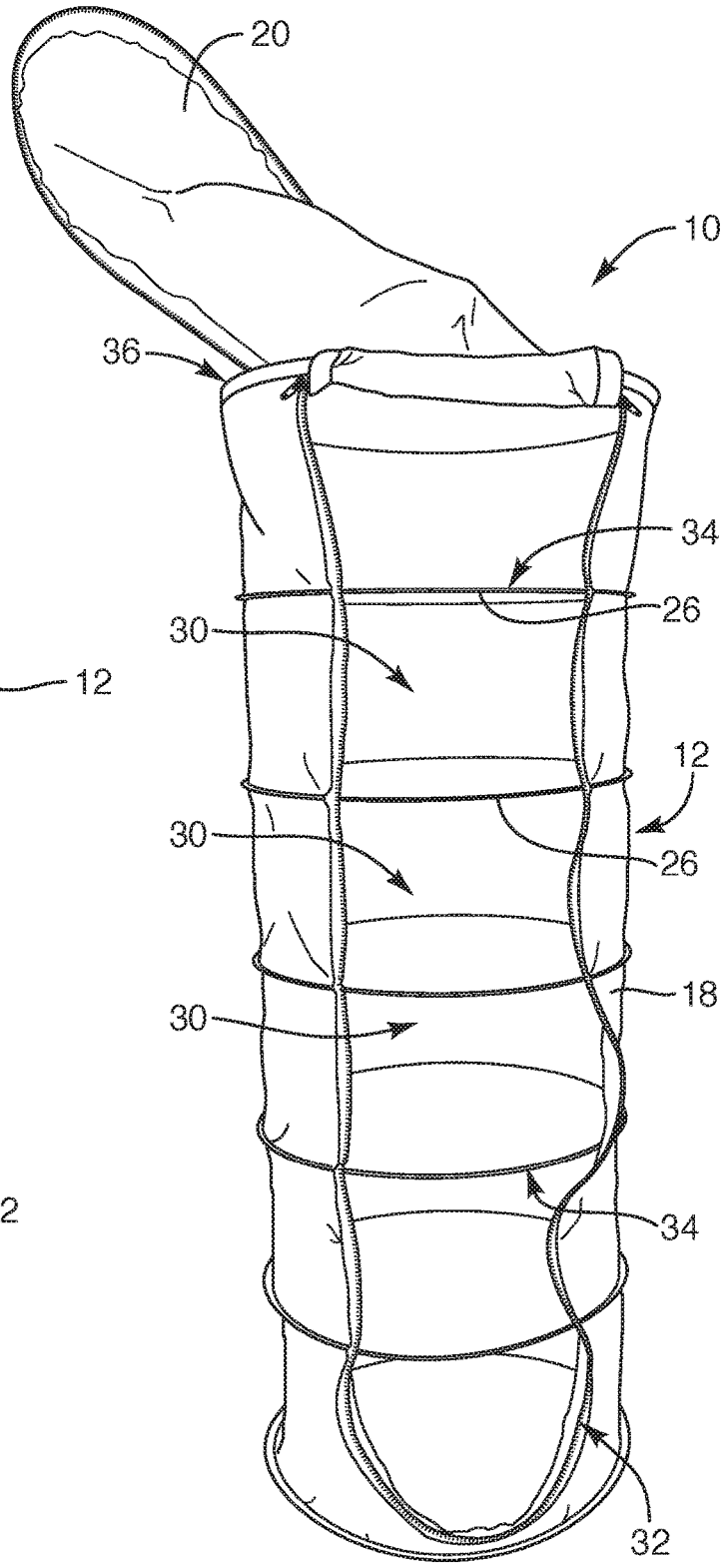
FIG. 3 is a perspective front view of the partitioned container in the expanded position, depicting the partitioned container and exhibiting the door flap moved away from its opening, according to another embodiment of the present invention.

The tubular liner 12 may include multiple storage regions 30. Such multiple storage regions 30 may be defined, at least in part, by the multiple partitions 26 and the flexible side wall 18. In one embodiment, the tubular liner 12 may include six storage regions positioned successively, one above another, in a single column. In another embodiment, the storage regions extend in a single column without dividers within a given storage region 30. In another embodiment, some storage regions may include dividers to define dual compartments within one of the storage regions 30. The first and second ends 14, 16 of the tubular liner 12 may also act as respective first and second end partitions so as to partially define the storage region 30 adjacent the first and second ends 14, 16. In another embodiment, the tubular liner 12 may include three storage regions. In another embodiment, the tubular liner 12 may include a range between three storage regions and six storage regions or more. With this arrangement, upon the door flap 20 being in an open position to define an opening 31, the door flap 20 facilitates ready access to the multiple storage regions 30. In one embodiment, the door flap 20 facilitates access to each of the multiple storage regions 30. In another embodiment, the door flap 20 facilitates access to some of the multiple storage regions 30. In another embodiment, the storage regions As depicted in FIGS. 2 and 3, the door flap 20 of the container 10 and tubular liner 12 may be moved between a respective closed position and the open position. The door flap 20 may be moveable between the closed and open positions with, for example, a zipper mechanism 32. In another embodiment, the door flap 20 may be moveable between the closed and open positions with snaps, Velcro, buttons, or any suitable mechanism for facilitating open and closed positions. In another embodiment, the door flap 20 may be partially opened so as to facilitate access to some of the storage regions 30.

Figure 4:
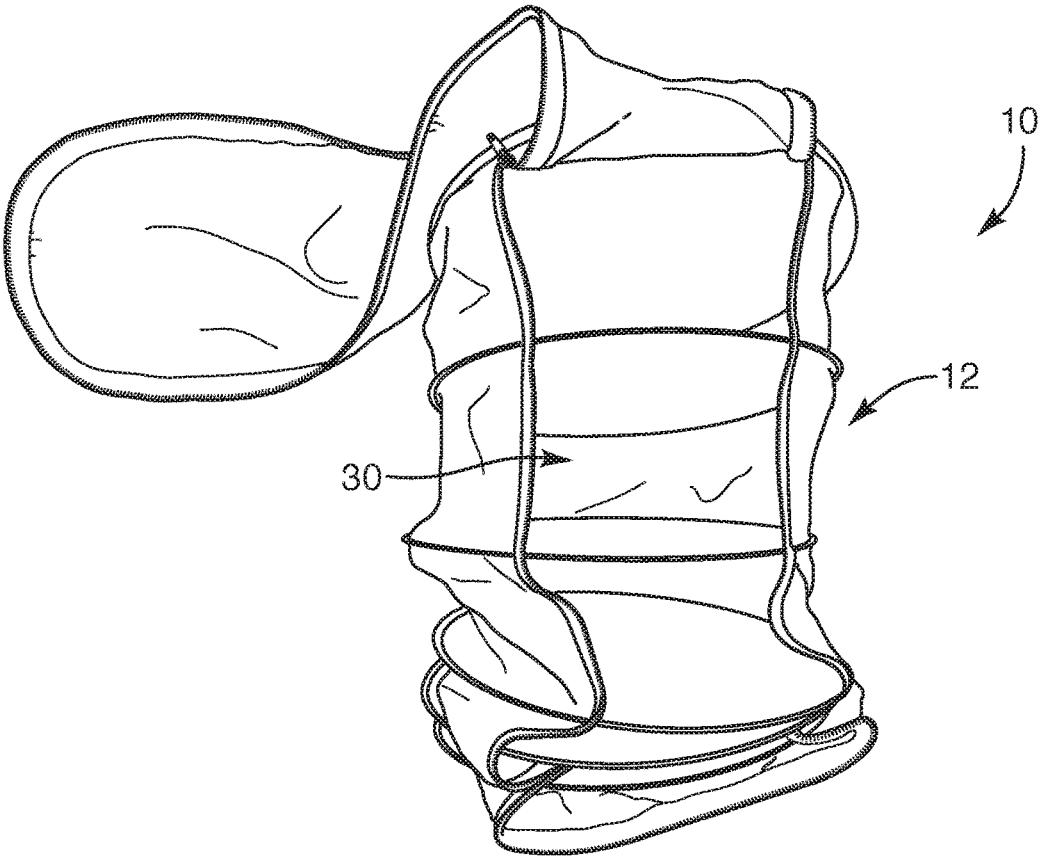
FIG. 4 is a perspective side view of the partitioned container in a partially expanded position or partially collapsed position, depicting the partitioned container laying on the ground in a non-hanging position, according to another embodiment of the present invention.

As depicted in FIGS. 4, 5, and 6, the container 10 and tubular liner 12 may be moveable to a partially collapsed state (FIG. 4) or a fully collapsed state (FIGS. 5 and 6). Such partially collapsed state may be employed, for example, for storing items (not shown) in some of the storage regions 30 and leaving other storage regions 30 empty, thereby, allowing the remaining storage regions 30 to be collapsed. In this manner, the tubular liner 12 may be adjusted to fit various sized main compartment spaces defined in various backpacks (not shown) or the like. Further, such partially and fully collapsed states of the tubular liner 12 readily facilitate portability of the container.

With respect to FIGS. 1 and 3, the flexible side wall 18 and/or the multiple partitions 26 may be a polymeric material, such as rip-stop nylon or the like, or any other suitable flexible material. Further, each of the multiple partitions 26 may include a circular member 34, such as a ring member, attached or embedded within a periphery of each of the multiple partitions 26. Such circular member 34 may be made from a resilient material, such as a polymeric or metallic material. The first end or first end partition may include a rigid circular member 36 or disc shaped member extending and attached to a periphery of the first end partition. In one embodiment, the rigid circular member 36 may be embedded or disposed within material of the tubular liner 12 and/or flexible side wall 18. Such rigid circular member 36 may be made of a polymeric material, metallic or composite material. Such circular member 34 and rigid circular member 36 may be attached to the flexible side wall 18 by, for example, sewing or the like, as known to one of ordinary skill in the art.

As depicted in FIGS. 1 and 6, the first end 14 may define an external surface with one or more straps 38, such as two straps, attached thereto. Such straps 38 may be made from a polymeric material and may be in the form of woven or webbed straps or the like. Further, the straps 38 may include an attachment mechanism 40, such as a clip or the like, that may facilitate hanging the container 10 from, for example, another clip or strap within a tent or hanging the container 10 from a tree or any member that may be convenient to the user.

Figure 7:
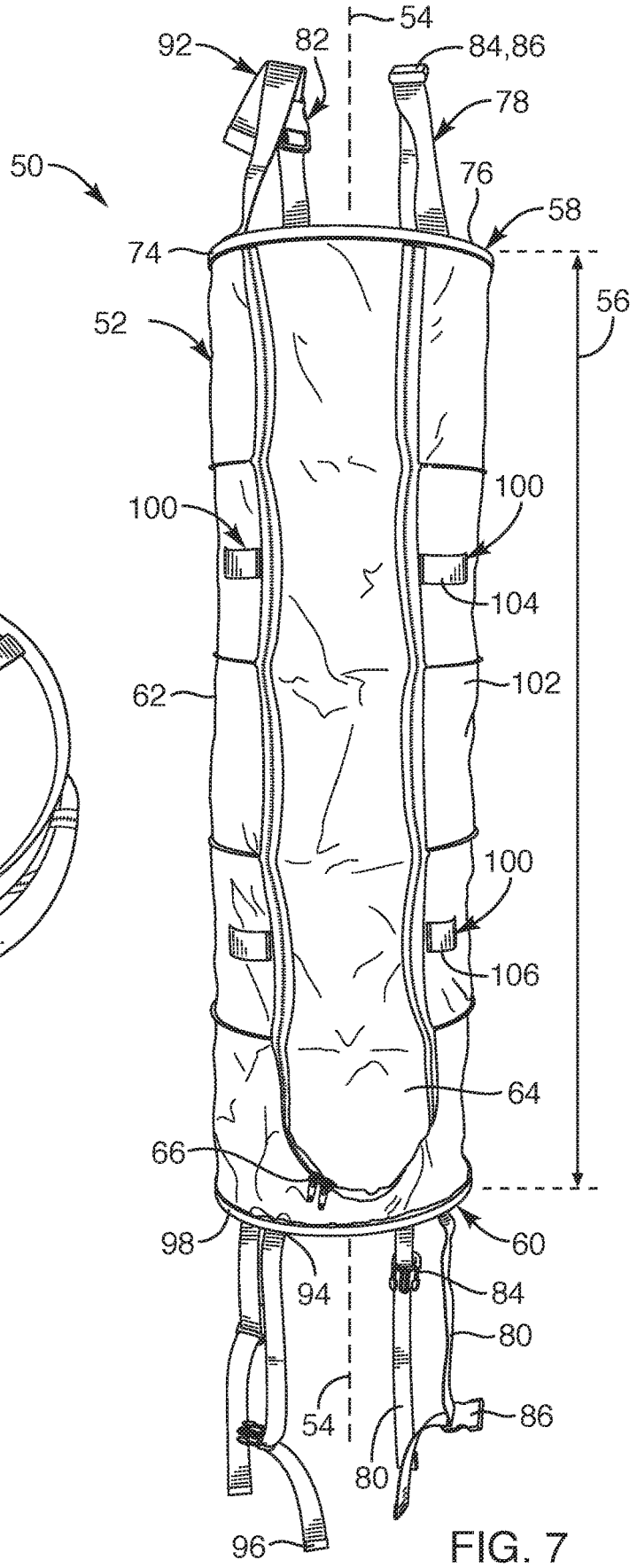
FIG. 7 is a perspective front view of another embodiment of a container with a door flap in a closed position, depicting the container in an expanded state with multiple straps at opposite ends of the container, according to the present invention.
Figure 8:
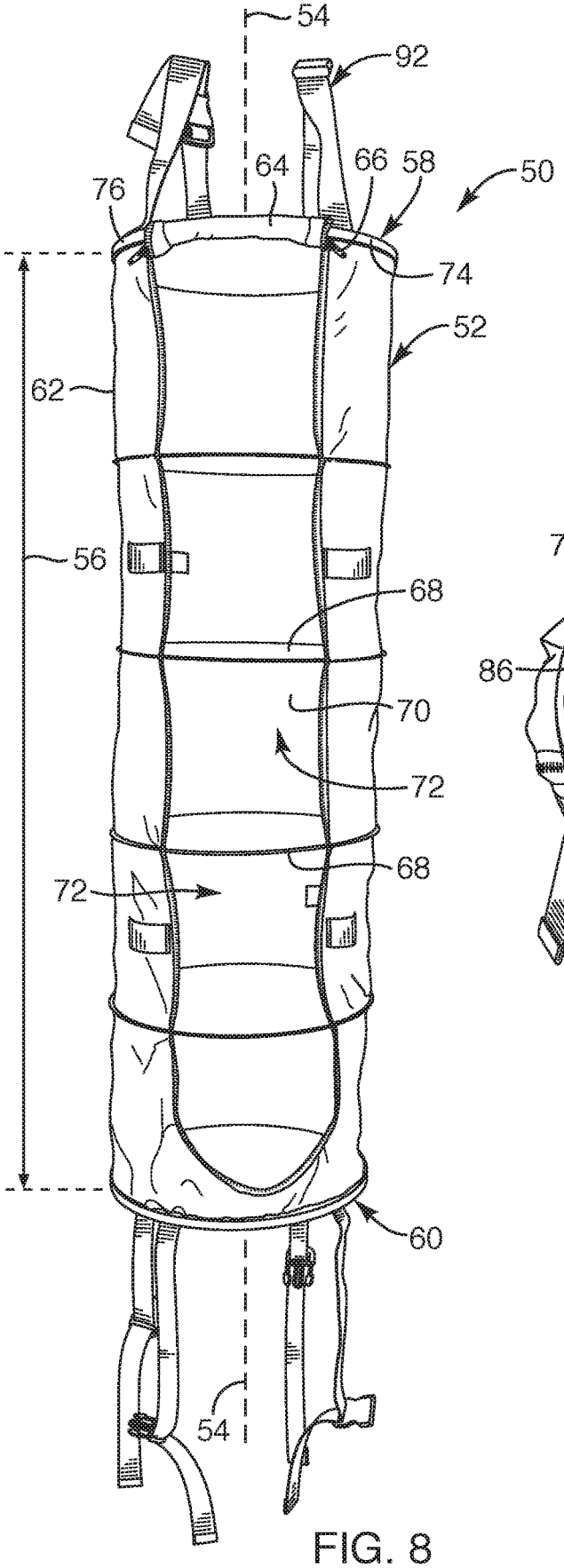
FIG. 8 is a perspective front view of the container of FIG. 7, depicting the container in the expanded state with the door flap in an open position to exhibit multiple storage regions defined by partitions within the container, according to another embodiment of the present invention.
Figure 9:
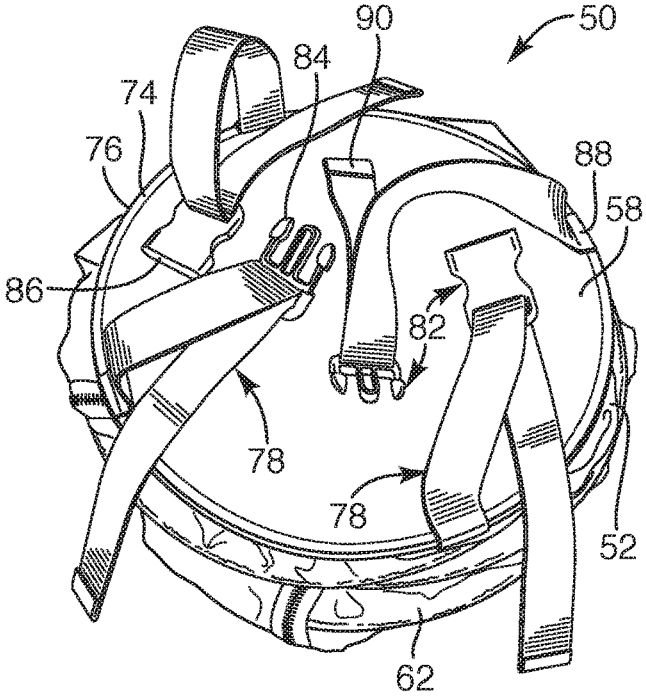
FIG. 9 is a perspective end view of the container in a collapsed position, depicting the multiple straps each having an adjustable coupling portion associated therewith, according to another embodiment of the present invention.

Now with reference to FIGS. 7, 8 and 9, another embodiment of a container 50 moveable between expanded and collapsed states is provided. This embodiment may include similar structure as the previous embodiment and may function similarly to that described previously and, as such, description of the previous embodiment may apply to this embodiment. For example, the container 50, in the expanded state, may include a tubular liner 52 or tubular member extending to define a longitudinal axis 54 extending centrally and axially along a longitudinal length 56 of the tubular liner 52. The tubular liner 52 may extend between a first end 58 and a second end 60 with a flexible sidewall 62 extending therebetween with a door flap 64 defined in the flexible side wall 62. The door flap 64 defined in the flexible side wall 62 may be moveable between opened and closed positions with a zipper mechanism 66. Further, the tubular liner 52 may include multiple partitions 68 spaced from each other and attached to an inner surface 70 of the flexible side wall 62 so as to define storage regions 72 within the tubular liner 52. In one embodiment, the tubular liner 52 may define a single column of storage regions 72, such as five of the storage regions 72, one above the other, as depicted. In another embodiment, the tubular liner 52 may extend in a single column to define a range of the storage regions 72, such as three, four, five, or six or more of the storage regions 72. Each of the multiple partitions 68 may be circular or disc shaped sized and configured to be attached to the inner surface 70 of the flexible sidewall 62. Further, first and second ends 58, 60 of the tubular liner 52 may also act as partitions and may be circular in shape with a resilient rigid structure embedded within material of the first and second ends 58, 60 of the container 50 such that a wall defined by the partitions along the first and second ends may be more stout than the wall defined by the other partitions between the first and second ends 58, 60. The container 50 may define a ribbing 74 of material along a periphery 76 of the first and second ends 58, 60 so as to extend in a circular manner.

Now with reference to FIGS. 7 and 9, in one embodiment, the container 50 may include multiple first end straps 78 and second end straps 80 extending from the periphery 76, such as from the ribbing 74, of each of the first and second ends 58, 60 of the container 50. Each of the first end straps 78 may include an adjustable buckle 82 or adjustable coupling portion, such as a male side release buckle 84 or a female side release buckle 86. For example, the first end 58, as depicted in FIG. 9, may include four of the first end straps 78, each of the first end straps 78 having one end 88 coupled adjacent to the periphery 76 of the first end 58 and the other end of each of the first end straps 78 being a free end 90. Such first end straps 78 may be fixed to the periphery 76 in a spaced apart manner, such as a symmetrical spaced apart manner. Further, along the periphery 76 of the first end 58, each first end strap 78 may include either the male side release buckle 84 or the female side release buckle 86 such that adjacently positioned first end straps 78 may include one male and one female side release buckle 84, 86. As such, the first end straps 78 with the male side release buckles 84 may be positioned opposite each other. Likewise, the first end straps 78 with the female side release buckles 86 may be positioned opposite each other. With this arrangement, at the first end 58 of the container 50, in one embodiment, only adjacently positioned first end straps 78 along the periphery 76 may be coupled together via a corresponding male and female side release buckles 84, 86. Further, upon coupling the adjacently positioned first end straps 78 with the corresponding male and female side release buckles 84, 86, the length of the coupled adjacent straps may form an upper loop portion 92 that may be adjusted, via an adjusting mechanism associated with either of the male and female side release buckles 84, 86, to a desired length. In this manner, the coupled first end straps that form the upper loop portion 92 may be hung over an object (not shown), such as a tree limb or a tent hanger (within a tent), so that the container 50 may be suspended by the first end straps 78 at a desired height by adjusting the length of the first end straps 78 to the desired length. Further, upon suspending or hanging the container 50 with the upper loop portion 92, the container 50 is disposed in the expanded state, as depicted in FIG. 7. Upon removing the container 50 from being suspended in the expanded state, the container 50 may be placed on, for example, the ground in which the container 50 will move to the collapsed state, as depicted in FIG. 9.

Figure 10:
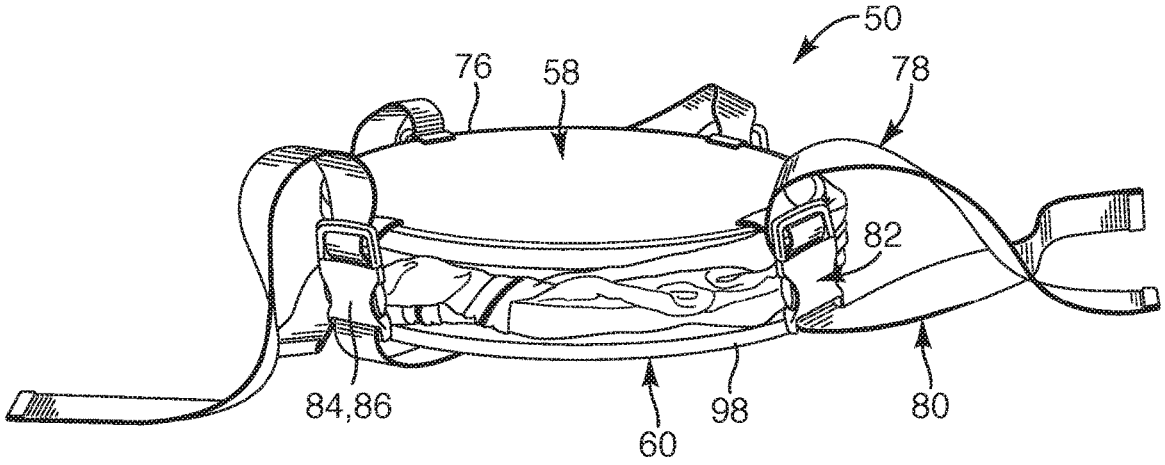
FIG. 10 is a perspective side view of the container, depicting the straps at each end of the container coupled together with the adjustable coupling portions maintaining the container in a compressed state, according to another embodiment of the present invention.
Figure 11:
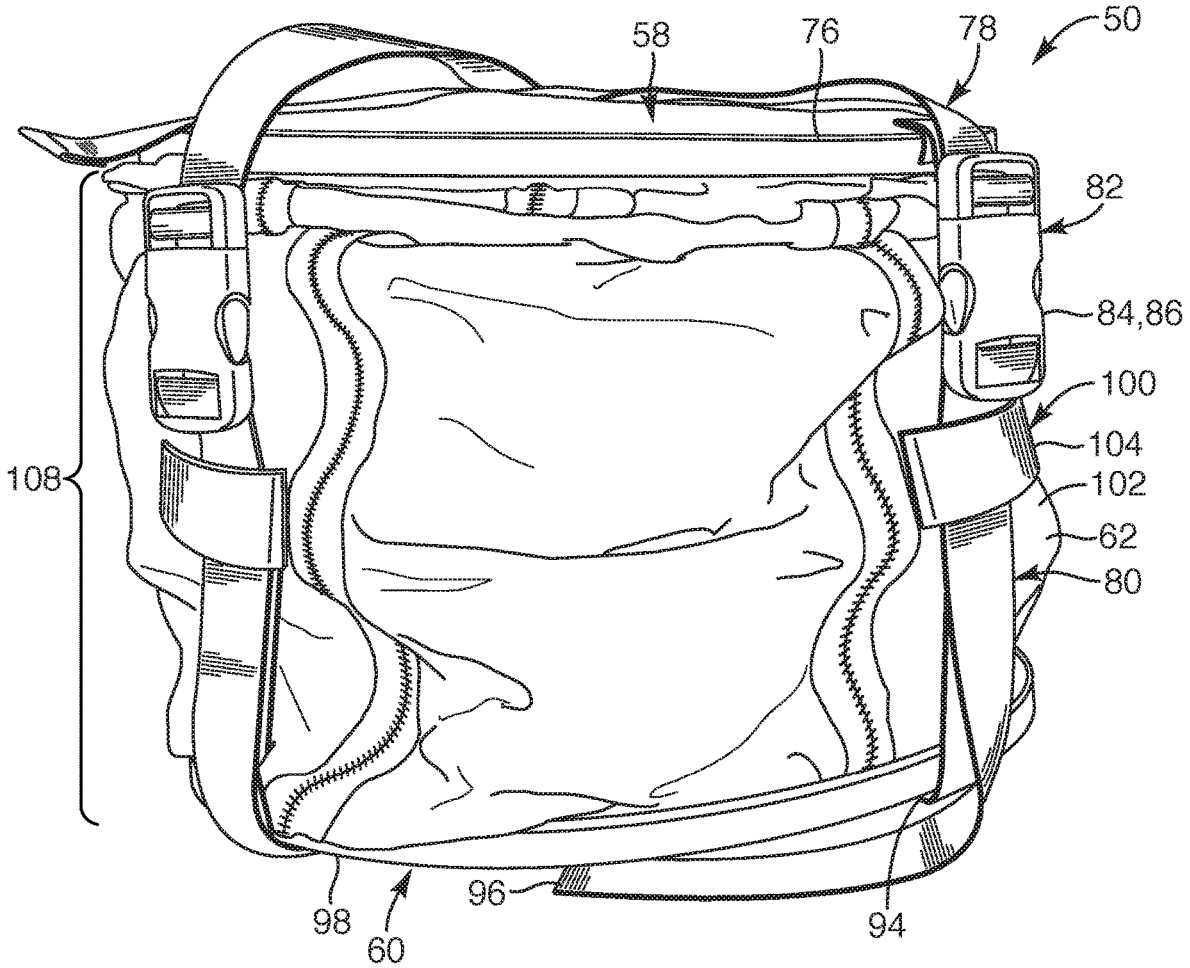
FIG. 11 is a perspective side view of the container in the compressed state, depicting the container having items positioned therein, according to another embodiment of the present invention.

Now with reference to FIGS. 7, 10 and 11, as previously indicated, the second end 60 of the container 50 may include second end straps 80 each associated with the before described adjustable buckle 82 or connector, such as the male or the female side release buckles 84, 86. Similar to the first end straps 78, the second end straps 80 may each extend between one end 94 being coupled to a periphery 98 of the second end 60 of the container 50 with the other end being a free end 96 of the second end straps 80. Each of the second end straps 80 may define a length that may be adjusted between the attached one end 94 and the male or female side release buckle 84, 86, similar to the first end straps 78. Such second end straps 80 may be positioned along the periphery 98 of the second end 60 to be aligned to correspond with the position of the first end straps 78 along the periphery 76 of the first end 58 so that each second end strap 80 may be coupled to one of the first end straps 78 via the male and female side release buckles 84, 86 associated with the respective first and second end straps 78, 80. For example, each one of the second end straps 80 may include either the male or female side release buckles 84, 86 that may be aligned to correspond with one of the first end straps 78 having one of the female side release buckle 86 or the male side release buckle 84. As such, upon coupling the second end straps 80 to the corresponding ones of the first end straps 78 with the associated male and female side release buckles 84, 86, the coupled first end straps 78 or second end straps 80 may be adjusted or tensioned so as to cinch down the first and second end straps 78, 80 to apply pressure upon and to compress the container 50. Alternatively, the adjustable buckles 82 may also be sized and configured to facilitate loosening the first and second end straps 78, 80, as desired. With this arrangement, the second end straps 80 may be coupled to the first end straps 78 to move and maintain the container 50 to the compressed state or compressed position, as depicted in FIG. 10. Further, upon putting items, such as cloths or the like, within one or more of the storage regions 30 of the container 50, the second end straps 80 may be coupled to the corresponding first end straps 78 to move and maintain the container 50 in the compressed state, as depicted in FIG. 11. In the compressed state, a size of the container 50, with or without items within the container 50, may be minimized to facilitate portability of the container 50 to readily be positioned within a backpack or daypack or the like.

Further, as depicted in FIGS. 7 and 11, the container 50 may include multiple loops 100 coupled to an exterior surface 102 of the flexible side wall 62 of the container 50. One or more of the loops 100, such as two loops, may be positioned along an exterior surface 102 of the flexible side wall 62 so as to be aligned between one of the first end straps 78 and one of the second end straps 80. For example, the loops 100 may include upper loops 104 and lower loops 106, the upper loops 104 being closer to the first end 58 and the lower loops 106 being closer to the second end 60 along the flexible side wall 62 of the container 50 such that one of the upper loops 104 and one of the lower loops 106 corresponds with and is aligned between the attachment points of one of the first end straps 78 and one of the second end straps 80. The upper and lower loops 104, 106 may be oriented and sized to facilitate inserting one or both of the first and second end straps 78, 80 therethrough, respectively, before coupling the first and second end straps 78, 80 together via the adjustable buckles 82. In this manner, each of the first end straps 78 may be coupled to a corresponding and aligned one of the second end straps 80 with the respective male and female buckles 84, 86. Further, the upper and/or lower loops 104, 106 may assist in centering and aligning a middle portion 108 of the container 50 between the first and second ends 58, 60 as the first and second end straps 78, 80 cinch down the middle portion 108 between the first and second ends 58, 60 of the container 50 to move the container 50 in the compressed state.

With reference to FIGS. 7, 8 and 11, one embodiment of how the container 50 may be employed for storing items therein is provided. For example, the container 50 may receive various desired items (not shown), such as various clothes, or toiletries or the like, placed within the storage regions 72 between the partitions 68 of the container 50 (see FIG. 8). Upon organizing the items within the container 50 as desired, the door flap 64 may then be moved to the closed position, (see FIG. 7). At this juncture, one or more of the first end straps 78 may then be threaded through one of the corresponding and aligned loops 100. Similarly, one or more of the second end straps 80 may be threaded through one of the corresponding and aligned loops 100. Alternatively, the first or second end straps 78, 80 may be threaded through only one of the corresponding upper or lower loops 104, 106. The first end straps 78 may then be coupled to the corresponding ones of the second end straps 78 via the male and female side release buckles 84, 86 associated with the first and second end straps 78, 80. Upon each of the corresponding first and second end straps 78, 80 being coupled together, each of the corresponding first and second end straps 78, 80 may be cinched down by pulling the respective free ends of the straps so as to pull the first end 58 and the second end 60 closer together to move the container 50 to the compressed state (see FIG. 11).

Figure 12:
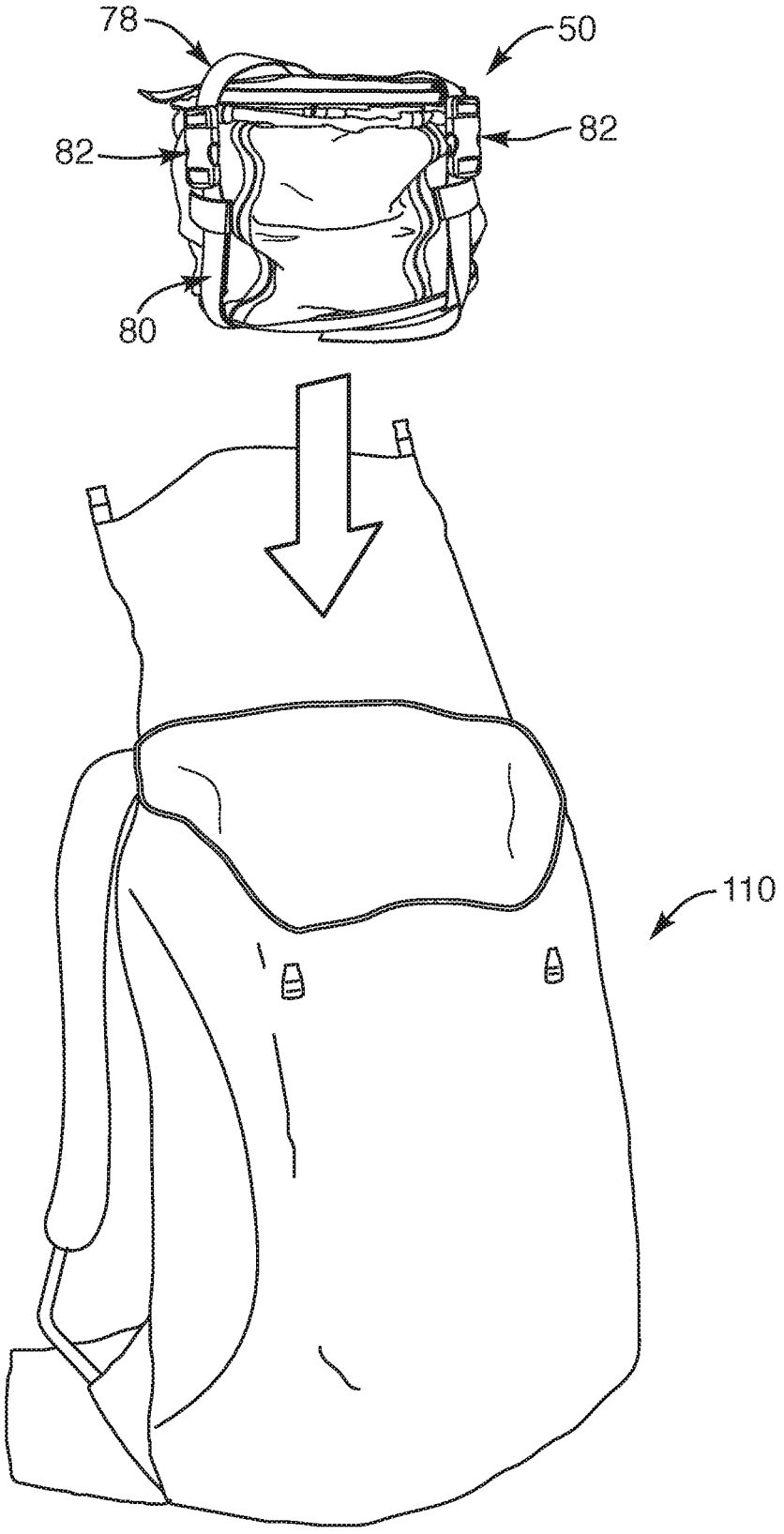
FIG. 12 is a perspective view of the container in the compressed state, depicting the compressed container being a size that is positionable within a backpack, according to another embodiment of the present invention.

Now with reference to FIGS. 7, 8 and 12, the compressed container 50, with the various items positioned within the storage regions 72, may then be placed in a backpack 110 or daypack or the like or other carry item, such as a duffle bag, for example. Upon reaching a destination, such as a camp site, the container 50, in its maintained compressed state, may then be removed, the first and second end straps 78, 80 loosened and the adjustable buckles 82 decoupled. The male and female side release buckles 84, 86 of the first end straps 78 may then be coupled together to form the upper loop portion 92 so that the container 50 may be suspended by the coupled first end straps 78 hung on any appropriate object. Such suspension of the container above the ground allows the container to move to the expanded state (see FIGS. 7 and 8). Further, the length of the first end straps 78 may be adjusted to a desired length so that the container 50 is suspended at a desired height from the object. At this juncture, the door flap 64 may be readily opened for access to the items in the storage regions 72 of the container 50. With this arrangement, the container 50 may be employed to store items therein in an organized manner with the container 50 in both the compressed state and the expanded state, the compressed state for placing the container in, for example, the limited space of a backpack, and the expanded state for maintaining ready access to the organized and stored items. As such, the functionality of the container facilitates portability of the container and the contents therein as an advantageous accessory for backpacking.

The first and second end straps 78, 50 may be made from a webbed strap material extending with a flat configuration. Further, the upper and lower loops 104, 106 may also be made from a webbed strap material. Such webbed strap material may be made from a polymeric material, such as Nylon or the like. The first and second end straps 78, 80 as well as the upper and lower loops 104, 106 may be attached to the container 50 with stitches by sewing or the like.

In another embodiment, the container may be integrally incorporated with a backpack or daypack. In this embodiment, the container may include similar features as the previous embodiments, such as a flexible side wall with multiple partitions extending from an internal surface and a door flap that may be openable to access storage regions defined by the multiple partitions. In still another embodiment, a container may be integrally incorporated with a duffle bag or the like.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes incorporating any portion of one embodiment with another embodiment, all modifications, equivalents, and alternatives falling within the spirit and scope of the invention as defined by the following appended claims.

What is claimed is:

1. A compressible container configured to store various items therein, the compressible container comprising:

a tubular liner extending between a first end and a second end and defining a longitudinal axis along a length of the tubular liner, the tubular liner including a flexible side wall with a door flap defined therein such that the tubular liner is moveable between an expanded state and a collapsed state, the flexible side wall of the tubular liner extending to define an interior surface and an exterior surface, the tubular liner including multiple spaced apart partitions extending from the interior surface of the flexible side wall so as to define multiple storage regions within the tubular liner to be accessible via the door flap, the tubular liner including multiple first end straps and multiple second end straps coupled to the first end and the second end, respectively, of the tubular liner, the tubular liner including loops attached to the exterior surface of the flexible side wall, each one of the loops positioned and aligned along the flexible side wall between one of the first end straps and one of the second end straps;

wherein, upon one of the first end straps being coupled to another one of the first end straps, the coupled first end straps are configured to facilitate hanging the tubular liner so that the tubular liner is disposed in the expanded state; and wherein, upon one of the first end straps being coupled to one of the second end straps so that one of the first and second end straps is coupled to one of the loops, at least one of the one of the first and second end straps are cinchable to move the tubular liner to a compressed state.

2. The compressible container of claim 1, wherein each of the multiple first end straps extend with a length between a fixed end and a free end, the fixed end coupled to the first end of the tubular liner with an adjustable coupling portion slidably attached along the length of each of the first end straps to facilitate adjusting a distance between the adjustable coupling portion and the fixed end.

3. The compressible container of claim 2, wherein the adjustable coupling portion comprises either a male coupling portion or a female coupling portion.

4. The compressible container of claim 1, wherein each of the multiple first end straps include one end coupled adjacent to a periphery of the first end of the tubular liner such that the one end of each of the multiple first end straps are spaced along the periphery.

5. The compressible container of claim 1, wherein each of the multiple second end straps include one end coupled adjacent to a periphery of the second end of the tubular liner such that the one end of each of the multiple second end straps are spaced along the periphery.

6. The compressible container of claim 1, wherein the loops comprise upper loops and lower loops, one of the upper loops and one of the lower loops being positioned and aligned on the exterior surface between one of the multiple first end straps and one of the multiple second end straps.

7. The compressible container of claim 1, wherein, upon coupling one of the first end straps to one of the second end straps, at least one of the first end straps and the second end straps are threadably coupled to one of the loops to assist the tubular liner being maintained in the compressed state.

8. A compressible container configured to store various items therein, the compressible container comprising:

a tubular liner extending with a flexible side wall between a first end and a second end, the flexible side wall extending to define an interior surface and an exterior surface, the tubular liner including multiple partitions spaced apart and each extending from the interior surface to define storage regions within the tubular liner and accessible through a door flap defined in the flexible side wall;

multiple first end straps each having one end coupled to the first end of the tubular liner, each one of the first end straps including a first coupling portion slidably coupled thereto so as to be slideable along the first end straps to adjust a length between the first coupling portion and the one end of each of the first end straps; and multiple second end straps each having one end coupled to the second end of the tubular liner, each one of the second end straps including a second coupling portion slidably coupled thereto so as to be slideable along the second end straps to adjust a length between the second coupling portion and the one end of each of the second end straps;

wherein the first coupling portion of one of the first end straps is configured to be coupled to the second coupling portion of one of the second end straps such that the first and second end straps are configured to be cinched down to move the tubular liner to a compressed state;

further comprising multiple loops coupled to the exterior surface of the flexible side wall, each loop being positioned and aligned between one of the first end straps and one of the second end straps such that one of the first and second end straps are threaded through one of the loops aligned therewith to assist in centering the tubular liner upon being cinched down to the compressed state.

9. The compressible container of claim 8, wherein the first coupling portion and the second coupling portion each comprise either a male coupling portion or a female coupling portion.

10. The compressible container of claim 8, wherein one of the first end straps is configured to couple to another one of the first end straps at the first end of the tubular liner such that the tubular liner is configured to hang by at least two of the first end straps to position the tubular liner in an expanded state.

11. The compressible container of claim 8, wherein the tubular liner extends to define a longitudinal axis along a length of the tubular liner such that the multiple partitions are oriented generally orthogonal relative to the longitudinal axis.

12. The compressible container of claim 11, wherein the loops comprise upper loops and lower loops, one of the upper loops and one of the lower loops being positioned and aligned on the exterior surface between one of the multiple first end straps and one of the multiple second end straps.

13. The compressible container of claim 8, wherein, in the compressed state, a size of the tubular liner and the items positioned therein are minimized to facilitate portability of the tubular liner.

14. A method for storing items in a backpack or daypack, the method comprising:

providing a tubular container extending with a flexible side wall between a first end and a second end, the flexible side wall extending to define an interior surface and an exterior surface, the tubular container including multiple partitions spaced apart and each extending from the interior surface to define storage regions within the tubular container, the tubular container including multiple first end straps and multiple second end straps coupled to the first end and the second end, respectively, of the tubular container, the tubular container including loops attached to the exterior surface of the flexible side wall, each one of the loops positioned and aligned along the flexible side wall between one of the first end straps and one of the second end straps;

accessing the storage regions through a door flap defined in the flexible side wall;

positioning the items within at least some of the storage regions of the tubular container;

extending at least one of the first end straps and one of the second end straps through one of the loops aligned therebetween;

coupling the one of the first end straps to the one of the second end straps with an adjustable tensioning coupling mechanism associated with at least one of the one of the first end straps and the one of the second end straps; and adjusting a length of at least one of the coupled one of the first end straps and the one of the second end straps with the adjustable tensioning coupling mechanism so as to cinch down the tubular container to a compressed state to minimize a size of the tubular container with the items stored therein and facilitate portability of the tubular container.

15. The method according to claim 14, wherein the extending and the coupling comprises extending four of the first end straps from the first end of the tubular container and extending four of the second end straps from the second end of the tubular container and coupling the four of the first end straps to corresponding and aligned ones of the four of the second end straps.

16. The method according to claim 14, further comprising decoupling the one of the first end straps from the one of the second end straps so that the tubular container is removed from the compressed state; and coupling one of the first end straps to another one of the first end straps to provide an upper loop portion with at least two of the first end straps for positioning the upper loop portion over an object so that the tubular container is suspended and moves to an expanded state.

17. The method according to claim 16, further comprising, in the expanded state, opening the door flap for accessing the items within the storage regions.

18. The method according to claim 14, further comprising decoupling the one of the first end straps from the one of the second end straps so that the tubular container is moved from the compressed state to a collapsed state.

19. The method according to claim 14, further comprising, in the compressed state, positioning the tubular container within an enclosable space within the backpack or the daypack.

* * * * *